US005904314A

United States Patent [19]

Babcock, Jr.

[11] Patent Number: 5,904,314

[45] Date of Patent: May 18, 1999

[54] FENCE WIRE DISPENSING APPARATUS

[76] Inventor: Lloyd A. Babcock, Jr., 3247 E. Lombard, Springfield, Mo. 65802

[21] Appl. No.: 08/389,904

[22] Filed: Feb. 16, 1995

[51] Int. Cl.[6] ..... B65H 16/02; B65H 23/00

[52] U.S. Cl. ..... 242/557; 242/566

[58] Field of Search ..... 242/557, 378.4, 242/388.6, 403.1, 533.8, 566, 403

[56] References Cited

U.S. PATENT DOCUMENTS

| | | | |
|---|---|---|---|
| 337,119 | 3/1886 | Bigelow . | |
| 428,525 | 5/1890 | Rein . | |
| 444,219 | 1/1891 | Grove . | |
| 567,213 | 9/1896 | Barger . | |
| 643,919 | 2/1900 | Thoma . | |
| 802,579 | 10/1905 | Manning . | |
| 875,476 | 12/1907 | Wasson . | |
| 906,547 | 12/1908 | Moss | 242/557 |
| 2,635,827 | 4/1953 | Stemm et al. . | |
| 2,664,253 | 12/1953 | Therrien | 242/557 |
| 2,896,877 | 7/1959 | Vaughn . | |
| 2,914,270 | 11/1959 | Parker et al. . | |
| 2,965,327 | 12/1960 | Blary . | |
| 3,048,348 | 8/1962 | Griffin . | |
| 3,168,262 | 2/1965 | Germain . | |
| 3,178,129 | 4/1965 | Parkinson . | |
| 3,464,647 | 9/1969 | Jacobi . | |
| 3,934,655 | 1/1976 | Whistle . | |

*Primary Examiner*—John Q. Nguyen
*Attorney, Agent, or Firm*—Shook, Hardy & Bacon L.L.P.

[57] ABSTRACT

An apparatus for dispensing wire from a spool for construction of a wire fence includes a frame adapted to be attached to a towing vehicle. A plurality of wire spool receiving compartments are attached to the frame. Each of the compartments includes a vertically oriented spindle adapted to receive a spool of wire. The compartments include a first row of laterally-disposed compartments and a second row of laterally-disposed compartments. The second row of compartments is disposed at a vertical location that is above the first row. Each of the compartments has an associated guide arrangement for guiding a strand of wire from a spool disposed in the compartment to a ground location as the apparatus is moved behind a towing vehicle. Each of the guide arrangements is laterally separated from its adjacent guide arrangements so that the strands of wire extending from the compartments are deposited in a substantially parallel orientation to one another. The strands are held in their parallel orientation by pins that are driven into the ground.

13 Claims, 4 Drawing Sheets

FENCE WIRE DISPENSING APPARATUS

This invention relates to an apparatus for dispensing fence wire and, more particularly to an apparatus for dispensing multiple strands of fence wire.

Utilizing common fence building techniques, construction of a fence with multiple wire strands is typically very time consuming and labor intensive. More specifically, a rancher or farmer first sets a row of fence posts along the boundary of the area to be enclosed. This commonly is done by pounding the posts into the ground at equally spaced locations utilizing a sledge hammer or a fence post driver.

Fence wire, for example, barbed wire, is normally purchased in wound spools. In order to string a first strand of wire, the rancher attaches the exposed end of the wire from the spool at an elevated location on the corner post of the fence row. The rancher then unwinds wire from the spool along the row of posts. The wire is not yet attached to the posts but lies on the ground adjacent the posts. The rancher then tensions the wire at a predetermined location along the post row. This can be done by utilizing a wire tensioning device. One such device grips the wire on one end and attaches to a fence post on the other end. The rancher operates the device to tension the wire. One typical tensioning device utilizes a ratchet mechanism to apply the tension. After the strand is tensioned, the strand is attached to the post to which the tensioning device is attached. This may be done by a wire clip if the post is of a metal variety or with a staple if the post is of a wood variety. The tensioned wire can then be attached to some or all of the intermediate posts between the corner post and the tensioning post by suitable clips or staples.

After the rancher has strung the first strand, the above-described steps are repeated for each of the other strands until the desired number of strands are attached to the fence post row.

The above fence building procedure is extremely labor intensive in that it requires the rancher to traverse back and forth along the fence post row to dispense each individual strand of wire. Additionally, if the rancher attempts to dispense multiple strands from multiple spools prior to attachment to the fence posts, the multiple strands oftentimes become entangled with one another because they are not uniformly positioned along the ground.

Various devices have been constructed to provide dispensing of multiple strands of wires from multiple spools. One such device is disclosed in U.S. Pat. No. 5,042,737. The device disclosed in this patent includes a row of laterally spaced spindle supports for receiving spools of wire. In use, a strand of wire from each respective spool is attached to a fence post. The device is then moved away from that post and parallel to the fence row. The device is moved incrementally along the fence row so that each strand of wire is tensioned and, thereafter, attached at its respective location along adjacent fence posts.

The device disclosed in this patent is disadvantageous for a number of reasons. First, because the spindle supports are disposed in one laterally-oriented row, it is often difficult to transport the device over roads and/or in and out of gates. In fact, in order to allow for transfer of the device, the patent discloses cumbersome add-on support spindles. Further, the wire is allowed to unroll from the spindle supports in a haphazard fashion without guidance, thus possibly creating entanglement between adjacent strands. One further major disadvantage of the device is that the movement of the device along the fence row is used to tension all the wire strands. Use of such movement for tensioning is likely to be cumbersome and inexact, thus oftentimes resulting in accidental disengagement of strands already attached. Disengagement of any wires from the posts during tensioning can result in serious injury to persons moving the device and/or persons working in the area.

Therefore, a multiple wire dispensing apparatus is needed which overcomes the drawbacks and deficiencies of the existing fence building techniques and devices discussed above.

Accordingly it is a primary object of the present invention to provide a wire dispensing apparatus which allows increased productivity and increased safety in the construction of a multi-strand fence.

Another primary object of the invention is to provide a wire dispensing apparatus that deposits multiple strands of wire onto the ground surface in a parallel and equally spaced orientation to allow easy attachment of the multiple strands to a row of fence posts.

A further object of the invention is to provide a wire dispensing apparatus that allows multiple strands of wire to be dispensed while minimizing the lateral width of the apparatus to allow for versatility in field use and for ease in transport.

A still further object of the invention is to provide a dispensing apparatus that provides increased safety by substantially enclosing and securely holding wire spools during dispensing.

Another object of the invention is to provide a dispensing apparatus that allows the storage of additional wire spools which can later be used in the dispensing mode of the device.

A further object of the invention is to provide a dispensing apparatus which allows convenient storage of and access to attaching clips, attaching staples and attaching tools.

These and other important aims and objects of the present invention will be further described, or will become apparent from the following description and explanation of the drawings, wherein:

FIG. 1 is a rear perspective view of a multi-wire dispensing wagon according to the principles of this invention, the wagon shown with the guide extensions in their outward operational configuration, with wire spools loaded in the receiving compartments, and with the receiving compartment covers in their closed positions, each wire spool shown dispensing a strand of wire from its respective compartment;

Figure 1:
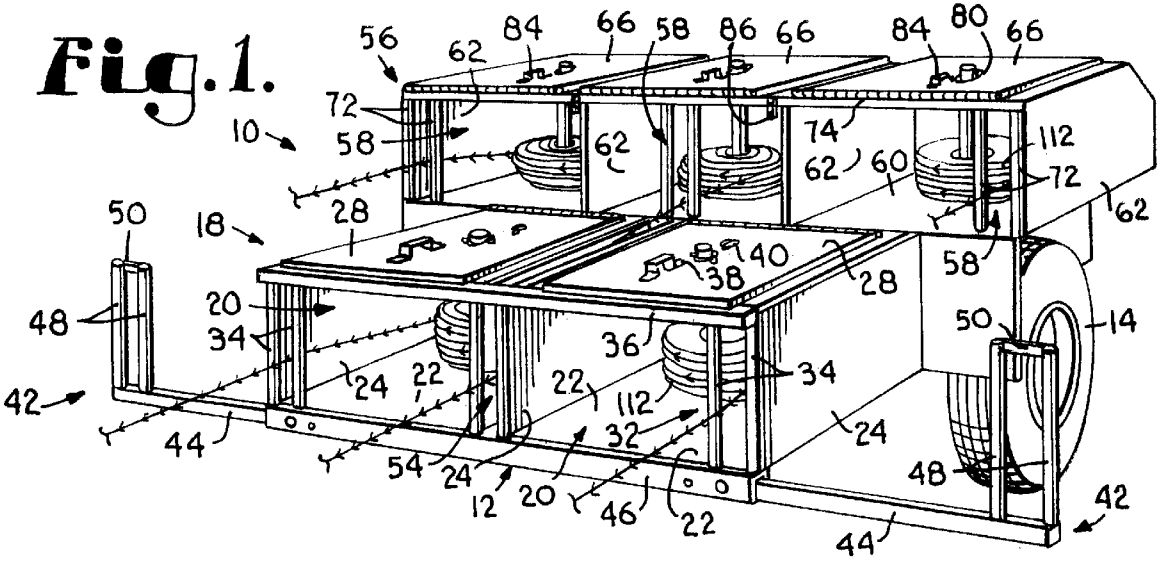

A multi-wire dispensing wagon embodying the principles of this invention is broadly designated in the drawings by the reference numeral 10. Wagon 10 has a frame 12 with a pair of wheels 14 rotatably mounted thereto as shown in FIGS. 1–5. A hitch 16 extends forwardly from frame 12 and is adapted to be attached to the back of a towing vehicle, for instance, a tractor or pickup truck.

A lower row 18 of wire spool receiving compartments 20 is mounted to the top of frame 12. Each compartment 20 is defined by a bottom 22, a pair of side walls 24, a front wall 26, and a cover 28 pivotally mounted adjacent front wall 26 and swingable between open and closed positions. The rear of each compartment 20 is generally open. Each compartment 20 also includes a vertically oriented spindle 30 for receiving a spool of wire. Each compartment 20 also has a guide arrangement 32 positioned adjacent the rear outside corner of the compartment. Each arrangement 32 comprises a pair of vertical posts 34, a portion of bottom 22 below, and a portion of a horizontal brace 36 above to form an enclosed rectangular area. Brace 36 extends across the upper rear edge of both compartments 20 in row 18. Each guide 32 receives a wire strand extending from a spool disposed in its respective compartment, as will be further described.

Figure 4:
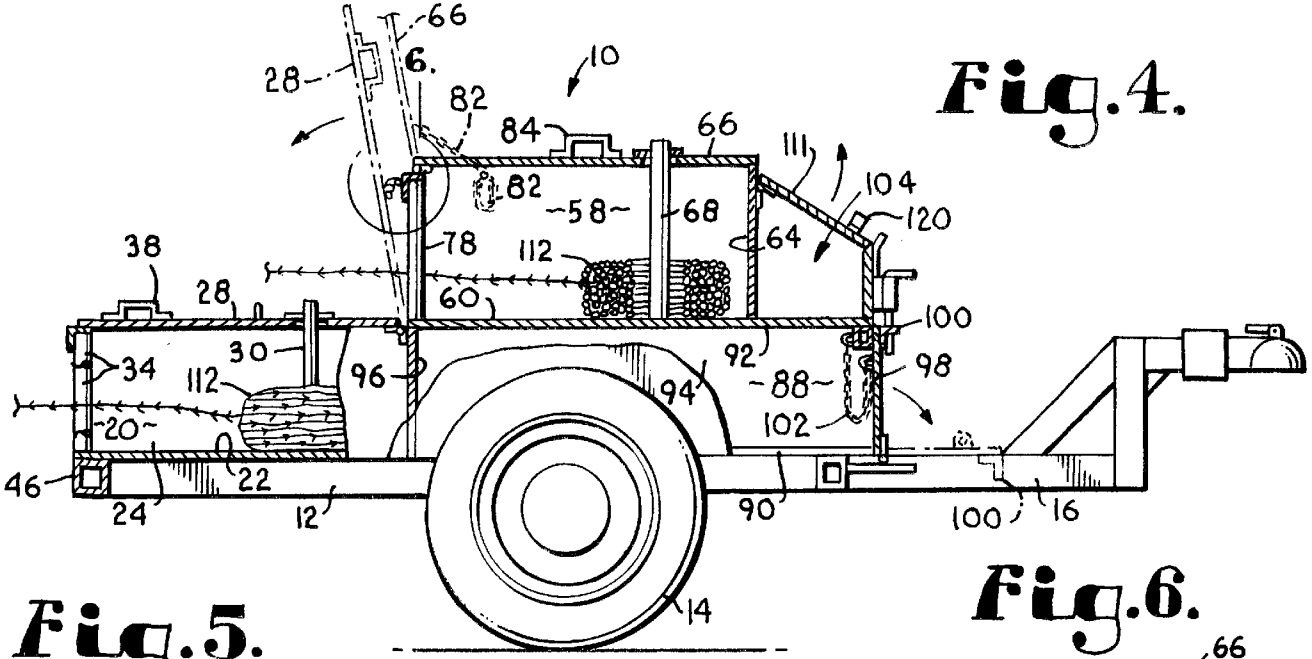
FIG. 4 is a side elevational view of the wagon shown in FIG. 1, parts being broken away to reveal details of construction, and showing the open positions of the compartment covers and the storage cabinet door in phantom lines.

Each cover 28 has a handle 38 for allowing easy opening and a ring 40 for securing the cover in its open position, as will also be more fully described. Each cover 28 when in its closed position secures a spool located in its respective compartment on its corresponding spindle 30. Each cover 28 has an aperture formed therein which receives the upper end of its respective spindle 30 when the cover is closed so that the upper end extends above the closed cover. A removable pin 29 is received in a pin hole formed in the upper end of the spindle and secures the cover in its closed position as best shown in FIG. 4. Each cover 28 rests along brace 36 when in its closed position.

Figure 3:
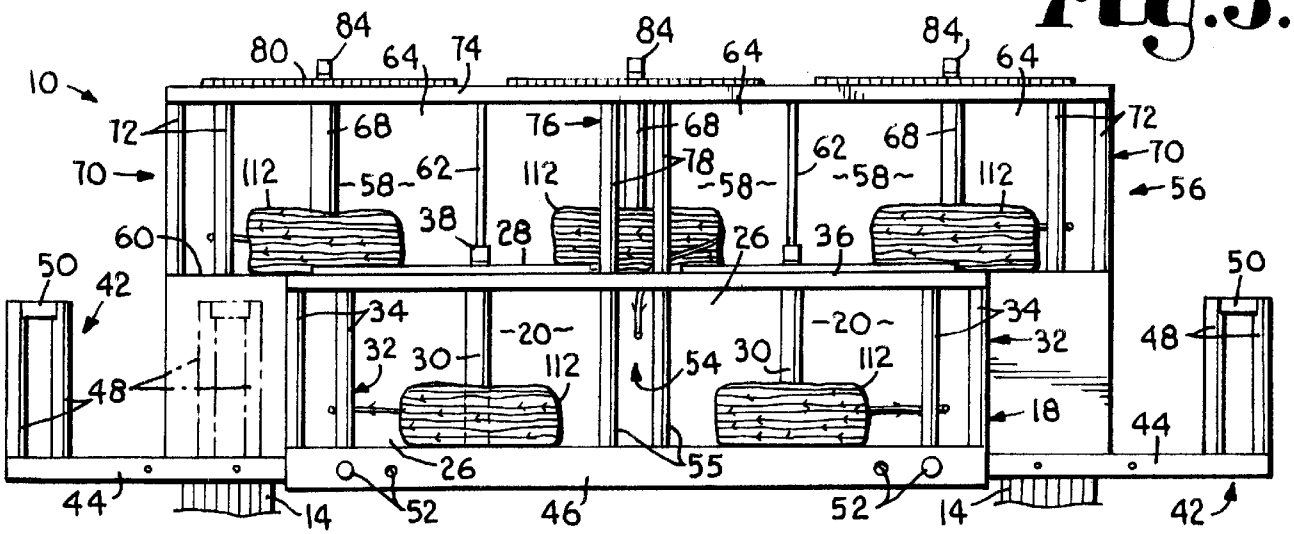
FIG. 3 is an enlarged fragmentary rear elevational view of the wagon shown in FIG. 1, the stowed position of one of the guide extensions being shown in phantom lines.

A pair of guide extension structures 42 extend from opposite sides of frame 12. Each extension 42 has a slide member 44 telescopically received in one end of a hollow portion 46 of frame 12. Each extension 42 further includes a pair of vertically oriented posts 48 extending upwardly therefrom and a top link 50 extending between posts 48 to form a rectangular enclosure. This rectangular enclosure receives a wire strand from one of the upper compartments, as will be more fully described hereinafter. Each extension 42 is positionable between an inward stowed position and an outward operating position as shown in FIG. 3. Each extension is secured in its desired position by removable pins 52.

The innermost side walls 24 of compartments 20 form a guide channel 54 therebetween. The rearward end of channel 54 has a rectangular enclosure formed by a pair of vertical posts 55, a portion of brace 36, and frame portion 46. Channel 54 with the rectangular enclosure formed at its rearward end receives a strand of wire from one of the upper compartments, as will be more fully described below.

As best shown in FIGS. 1 and 3, guides 32, guide extensions 42, and guide channel 54, all lie in substantially the same horizontal plane. Further, with extensions 42 in their deployed positions, each of the guide structures is approximately equally spaced from adjacent guide structures. The importance of this arrangement will be discussed later.

Wagon 10 also has an upper row 56 of wire spool receiving compartments 58. Each compartment 58 is formed by a bottom 60, side walls 62, a front wall 64, and a cover 66 pivotally mounted adjacent the rear of the compartment and swingable between open and closed positions. The rearward portion of each compartment 58 is generally open. Each compartment 58 has a vertically-oriented spindle 68 extending upwardly from its bottom and for receiving a spool of wire. The two outermost compartments 58 each have a guide arrangement 70 positioned adjacent the rearward end of their outermost side walls. Each guide 70 includes a pair of vertical posts 72 extending upwardly from the bottom of the compartment and a portion of a brace 74 extending between the posts to form a generally rectangular enclosure. The rectangular enclosure receives a strand of wire extending from a spool disposed in the compartment. Brace 74 extends across the upper rear edge of all compartments 58. Brace 74 also serves as the mounting surface for the hinge structures of covers 66.

The central upper compartment 58 has a guide arrangement 76. Guide 76 includes a pair of vertical posts 78 extending upwardly from the bottom of the compartment and connected together at the top by a portion of brace 74 to form a rectangular enclosure. This rectangular enclosure receives a wire strand extending from a wire spool disposed in the central compartment.

Figure 6:
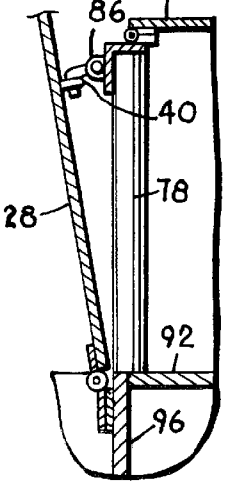
FIG. 6 is an enlarged fragmentary view of the region indicated by the numeral 6 in FIG. 4.
Figure 5:
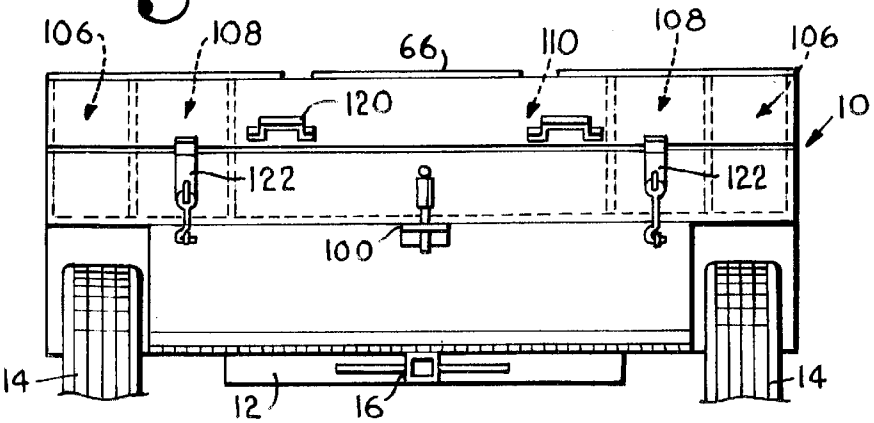
FIG. 5 is a fragmentary front elevational view of the wagon shown in FIG. 1 with the storage cabinet door and the fastener storage box cover in their closed positions.

Each cover 66, when in its closed position, secures a wire spool disposed in its corresponding compartment on its corresponding spindle 68. Each cover 66 has an aperture formed therein which receives the upper end of its respective spindle 68 when the cover is closed so that the upper end extends above the closed cover. A removable pin 80 is received in a pin hole formed in the upper end of the spindle and secures the cover in its closed position, as best shown in FIG. 4. Each cover 66 also has a chain 82 to support it in its open position and a handle 84 to allow easy opening of the cover. Brace 74 has hooks 86 disposed thereon for engaging rings 40 of covers 28 to support covers 28 in their open position, as shown in FIG. 6.

Figure 2:
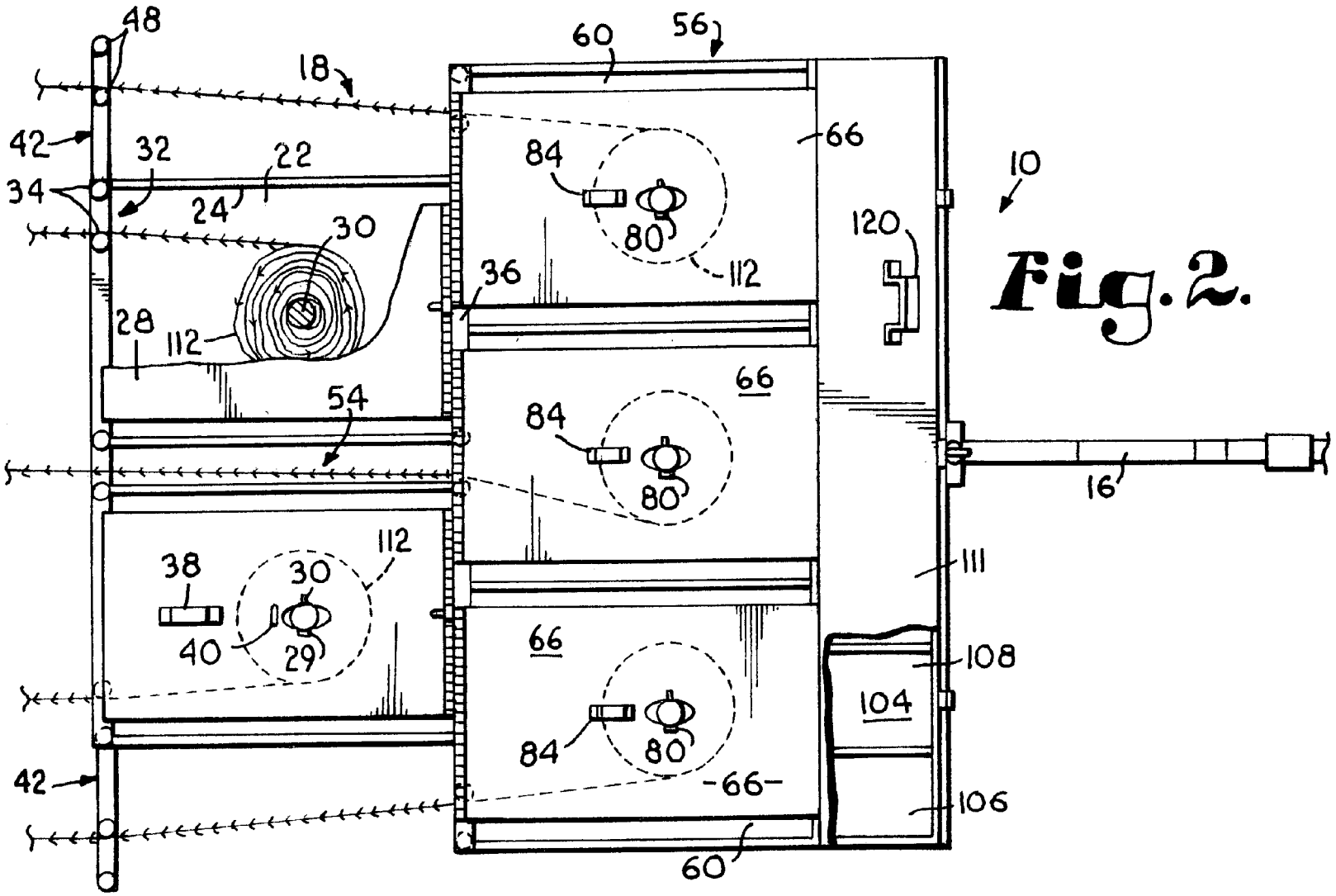
FIG. 2 is a top plan view of the wagon shown in FIG. 1, parts being broken away to reveal details of construction.

Upper compartments 58 are laterally offset with respect to lower compartments 20 as shown in FIGS. 1–3. This orientation along with the vertical positioning of the upper compartments above the lower compartments allows for reduction of the lateral width of the wagon while maintaining the ability to dispense five strands of wire from five different spools.

Disposed below and supporting row 56 of compartments 58 is a wire spool storage cabinet 88 as shown in FIG. 4. Cabinet 88 is defined by a bottom 90, a top 92, a pair of side walls 94, a rear wall 96, and a forward door 98. Door 98 is pivotally mounted adjacent the forward edge of bottom 90 and is swingable between open and closed positions. Door 98 can be secured in its closed position by a latch 100. Further, chain 102 supports door 98 substantially parallel to the ground when the door is in its open position. Cabinet 88 can store from six to fifteen spools of wire depending upon the gauge of the wire and the manufacturer. Spools stored in the cabinet are used to replenish the spools disposed in compartments 20 and 58, thus eliminating the need to return to a storage location to load additional spools.

A tool and fastener storage box 104 is disposed above the forward portion of cabinet 88 and immediately forward of row 56 of compartments 58. Box 104 is divided into staple bins 106, wire clip bins 108, and a tool bin 110. A cover 111 is pivotally attached adjacent the rearward end of box 104 and is swingable between open and closed positions to expose or cover bins 106, 108 and 110. Cover 111 also has handle 120 and a pair of latches 122 to secure it in its closed position. By having one staple bin 106 and one staple bin 108 positioned adjacent each side of wagon 12, a user is allowed easy access to attaching items no matter which side of the wagon is closest to the fence row, thus increasing the efficiency of fence construction.

Figure 7:
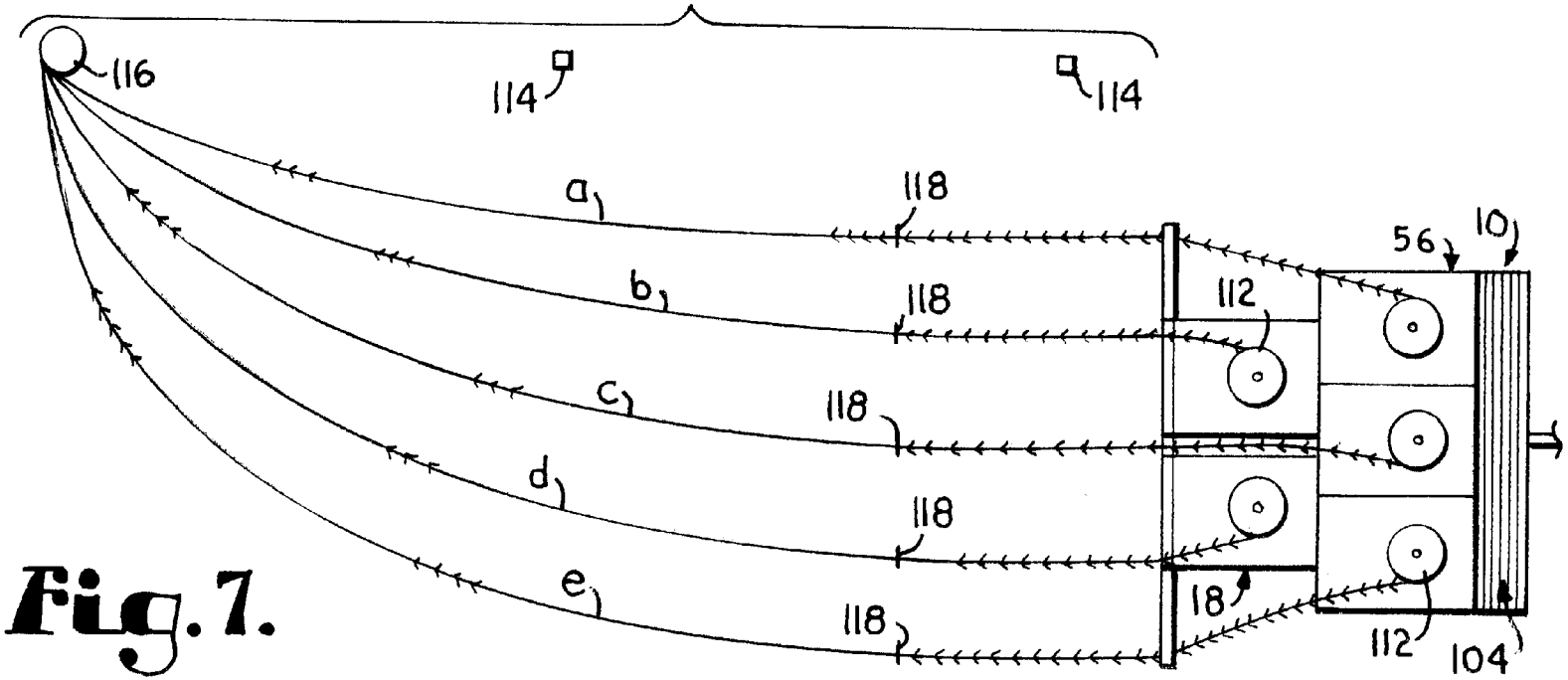
FIG. 7 is a top diagrammatic view of the wagon of the present invention showing the wire strand preparation and connection prior to dispensing of the strands from the wagon.

In use, extensions 42 are first slid and locked in their outer positions, as shown in FIGS. 1–3. With the covers 28 and 66 of the compartments 20 and 58, respectively, in their open positions, wire spools 112 are loaded into the compartments. Each spool 112 is received on a spindle 30 or 68 located in the compartment. Spools 112 can freely spin on their respective spindles in order to unroll wire for the spools. Still with the covers in their open positions, a strand of the wire is unrolled from each spool and threaded through the respective guide arrangement 32, 70 or 76. The figures illustrate one preferred unrolling orientation of the spools located in the compartments. That is, the spools located in the compartments 20 and 58 located adjacent the left side of the wagon preferably are unrolled in a counterclockwise direction when viewed from the top of the wagon, and the spools located in the compartments 20 and 58 located adjacent the right side of the wagon preferably are unrolled in a clockwise direction when viewed from the top of the wagon, as best shown in FIGS. 2 and 7. The wire spool located in the central compartment 58 of the upper row 56 can be unrolled in either the clockwise or counterclockwise direction.

The end of the strand of wire extending from the spool in each lower compartment 20 can be temporarily tied off to the innermost vertical post of the associated guide 32. The cover to each compartment 20 then is closed and pinned in place by pins 29, thus securing the spool on its spindle while still allowing unrolling of wire. The end of the strand of wire extending from the spool in each outermost upper compartment 58 can be temporarily tied off to the innermost vertical post of the associated guide 70. The respective cover 66 then is closed and pinned in place by pins 80, thus securing the spool on its respective spindle. Further, the end of the strand extending from the spool located in the central upper compartment 58 extends through its guide 76 into the top of guide channel 54 and through the rectangular enclosure form on the rearward end of channel 54. This end can also be temporarily tied to the portion of brace 36 located adjacent the upper rearward edge of channel 54. The cover 66 for central compartment 58 can then be closed and pinned in place.

After all the covers of the compartments have been closed and pinned in place, wagon 10 is pulled by a towing vehicle so that it is parallel to a row of fence posts 114 and beyond the corner post 116 of the row by approximately 20 feet as shown in FIG. 7. The edge of the extension 42 located adjacent the fence post row is approximately three feet away therefrom.

Figure 8:
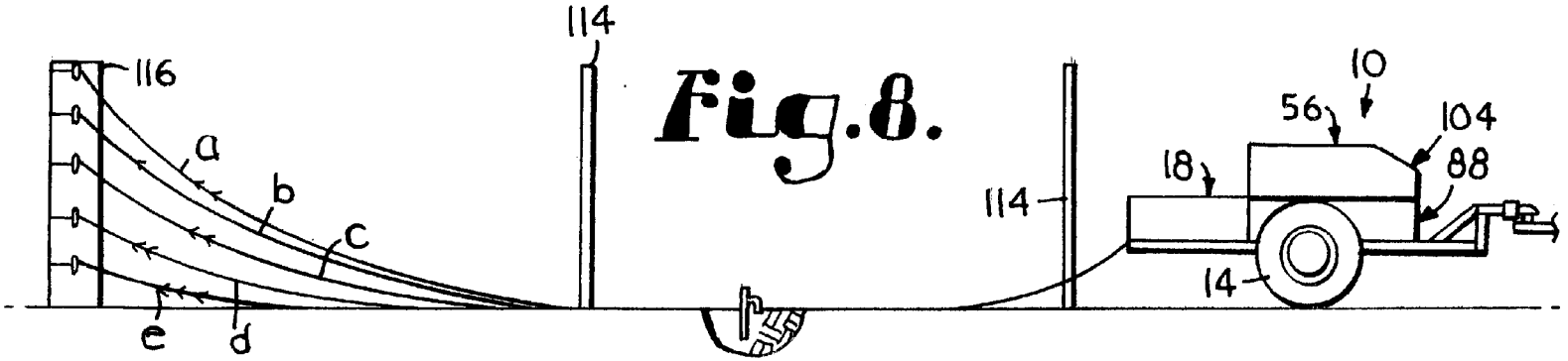
FIG. 8 is a side diagrammatic view of the structures shown in FIG. 7.

With reference to FIG. 7, a strand "a" of wire extending from the upper compartment 58 located closest to the fence post row is untied from its stowed position and fed through the rectangular enclosure formed on the adjacent guide extension 42 and attached to the highest vertical location on corner post 116 by tieing, stapling, or other suitable attaching means. Strand "a" will be the highest strand of wire of the fence. As best shown in FIG. 8, a portion of strand "a" lies along the ground and is curved upwardly to its elevated position on the corner post. A strand "b" is then untied from its stowed position on the lower compartment 20 located closest to the fence row and attached to the second highest location on corner post 116. Strand "b" also partially lies along the ground, as shown in FIG. 8. Strand "b" will form the second highest strand of the fence. A strand "c" is detached from its stowed position on brace 36 and attached to an intermediate location on corner post 116. Strand "c" will form the middle strand of the fence. A strand "d" extends from the lower compartment 20 furthest away from the fence row and is attached to the second lowest position on the corner post. A strand "e" extends from the upper compartment 58 located furthest away from the fence row and extends through the rectangular enclosure of the adjacent guide extension 42 and is attached to the lowest location on the corner post. Strand "e" will be the bottom strand of the fence row.

Once each of the strands is manually extended rearwardly from the wagon through its respective guide arrangements and manually attached to corner post 116 at its respective location, each of the strands is then pinned to the ground at pin points 118 by pins 120. Each pin 120 hooks its respective strand of wire as it is driven into the ground adjacent the strand. The purpose of the five pin points is to keep the strands separated as they are being dispensed from the wagon and to reduce stress on the attachments of the strands to the corner post during dispensing.

After the strands have been pinned, the tow vehicle with the wagon attached thereto is driven parallel to the fence post row thus dispensing five equally spaced parallel strands of wire behind it. The wagon is driven past and stopped at a point that is beyond a main line post (not shown) which is the post the rancher intends to use to apply tension to the wire. After the wagon has been stopped at this point, the pins 120 used to secure the strands to the ground at points 118 are removed. As described, the closest wire to the fence, strand "a", will be the top wire of the fence. Strand "a" is tensioned using any desired method, for instance, a tensioning device utilizing a ratchet mechanism. After strand "a" is tensioned, it is attached to the main line post by any suitable means, for example, a staple. The next closest wire to the fence row, strand "b", then is tensioned and attached to the main line post at the second highest location. Strands "c", "d" and "e" are attached to the main line post in the same manner. After all the strands have been attached to the main line post, they then are attached to all the intermediate posts by a suitable attaching clip or staple. Further sections of the fence can be completed by repeating the above procedure for these sections.

The wagon 10 is preferably fabricated using sheet metal and metal bar stock. The structures of the wagon are connected together by any suitable means, for example, welding.

The wagon of the present invention utilizes its guide arrangements to position a plurality of wire strands along the ground in parallel and equally spaced relationship so that they can be easily attached to the fence posts and do not become entangled with each other. Additionally, the combination of guide extensions 42 and the offset orientation of lower compartments 20 and upper compartments 58 allows a wide dispersement of the wires along the ground while at the same time providing a structure that is easily converted to a storage configuration for transport. Further, the fact that compartments 20 and 58 are substantially enclosed prevents possible user contact with the spools during dispensing, thus greatly increasing the safety of the device. Also, the unique storage cabinet provides increased productivity during fence construction by reducing the need to return to a site where the wire spools are stored.

Having described the invention, what is claimed is:

1. An apparatus for dispensing wire strands from wire spools for construction of a wire fence, the apparatus comprising:

a frame adapted to be attached to a towing vehicle;

a plurality of wire spool receiving compartments attached to said frame, each of said compartments isolating each of the wire spools from all other wire spools, each of said compartments including a vertically-oriented spindle adapted to receive a spool of wire, each of said spindles being fixed in a corresponding compartment, said plurality of compartments including a first row of laterally-disposed compartments and a second row of laterally-disposed compartments, said second row disposed at a vertical location that is above said first row, each of said compartments having associated guide means for guiding a strand of wire from a spool disposed in said compartment to a ground location as the apparatus is moved behind the towing vehicle, each of said guide means being fixed in location during operation of the apparatus, each of said guide means laterally separated from adjacent guide means so that the strands of wire extending from said compartments are deposited in a substantially parallel orientation to one another.

2. The apparatus of claim 1 wherein all of said guide means dispense the wire strands to substantially the same horizontal plane, said dispensing plane being generally lower than said second row of compartments.

3. The apparatus of claim 2 wherein said guide means are substantially equally spaced from one another so that the wire strands are positioned on the ground in a substantially equally-spaced parallel orientation.

4. The apparatus of claim 2 wherein each of said guide means associated with an outermost compartments of said second row are attached to extension means for extending said guide means laterally outwardly away from said frame when the apparatus is in an operating orientation and for allowing positioning of said guide means closer to said frame when the apparatus is in a non-operating orientation.

5. The apparatus of claim 4 wherein each of said guide means associated with said compartments of said second row includes a preliminary upper guide structure and a final lower guide structure, said preliminary upper guide structure for guiding the wire strand extending from its respective compartment to the compartments associated final lower guide structure.

6. The apparatus of claim 5 wherein each of said final lower guide structure and each of said upper preliminary guide structure comprises a rectangular enclosure, the wire strand being threaded through said enclosure during operation of the apparatus.

7. The apparatus of claim 4 wherein said compartments on said second row are laterally-offset from adjacent compartments on said first row for allowing effective dispensing of wire strands while limiting a lateral width of the apparatus.

8. The apparatus of claim 7 wherein said first row of compartments is longitudinally-offset from said second row of compartments, said apparatus further comprising a wire spool storage cabinet located directly below said second row of compartments.

9. The apparatus of claim 8 further comprising a storage box disposed forward of said second row of compartments and for storing attachment items and tools, said storage box extending laterally across an entire width of the apparatus so as to allow access from either side of the apparatus.

10. The apparatus of claim 1 further comprising a pair of wheels attached to said frame and a hitch tongue attached to said frame and adapted to allow attachment of the apparatus to the towing vehicle.

11. The apparatus of claim 1 wherein each compartment has a cover pivotally attached thereto and swingable between an open position and a closed position, each cover securing a wire spool located in its corresponding compartment on its corresponding spindle when in a closed position.

12. The apparatus of claim 11 wherein each said spindle extends through each said cover.

13. The apparatus of claim 12 wherein a pin extends through a section of said spindle extending through said cover.

* * * * *